US010927600B2

(12) United States Patent
Park

(10) Patent No.: US 10,927,600 B2
(45) Date of Patent: Feb. 23, 2021

(54) COMBINATION OF TWO SAFETY ATTACHMENTS FOR LADDERS

(71) Applicant: Bobby Park, Largs (GB)

(72) Inventor: Bobby Park, Largs (GB)

( * ) Notice: Subject to any disclaimer, the term of this patent is extended or adjusted under 35 U.S.C. 154(b) by 103 days.

(21) Appl. No.: 16/501,535

(22) Filed: Apr. 29, 2019

(65) Prior Publication Data

US 2020/0270947 A1 Aug. 27, 2020

Related U.S. Application Data

(63) Continuation-in-part of application No. 14/876,559, filed on Oct. 6, 2015, now abandoned.

(51) Int. Cl.

| | |
|---|---|
| ***E06C 1/04*** | (2006.01) |
| ***E06C 1/18*** | (2006.01) |
| ***E06C 7/18*** | (2006.01) |

(52) U.S. Cl.

CPC ..... *E06C 7/187* (2013.01); *E06C 1/04* (2013.01)

(58) Field of Classification Search

CPC . E06C 7/18; E06C 7/181; E06C 7/182; E06C 7/183; E06C 7/187; E06C 7/188; E06C 7/48; B25B 1/00; B25B 1/04; B25B 1/125

USPC ... 248/228.1, 228.3, 229.12, 229.14, 229.22, 248/229.24, 230.3, 230.5, 231.41, 231.61; 182/107; 269/79, 243, 244, 245, 246, 269/249, 253

See application file for complete search history.

(56) References Cited

U.S. PATENT DOCUMENTS

| | | | | | |
|---|---|---|---|---|---|
| 177,328 | A * | 5/1876 | Gardner | B25B 1/08 | 269/218 |
| 240,217 | A * | 4/1881 | Allen | B21D 1/06 | 72/460 |
| 1,236,269 | A * | 8/1917 | Cole | E06B 9/50 | 248/267 |
| 3,131,900 | A * | 5/1964 | Anderson | E06C 7/14 | 248/210 |
| 3,239,210 | A * | 3/1966 | Hustead | B25B 1/103 | 269/208 |
| 3,601,295 | A * | 8/1971 | Lowe | B60R 9/06 | 224/42.38 |
| 4,002,328 | A * | 1/1977 | Wolff | B25B 1/103 | 269/97 |
| 4,062,519 | A * | 12/1977 | Jacobs | A63C 19/06 | 160/331 |

(Continued)

*Primary Examiner* — Joshua E Rodden

(57) ABSTRACT

An assembly having two safety attachments for attaching to stiles of a ladder that will improve grip of the ladder against a surface it is in contact with during use. Each safety attachment incorporates a gliding channel section and a non-gliding channel section, each formed to accept a range of ladder stile sizes therebetween. The gliding channel section sliding along a screw threaded rod. The screw threaded rod including a rotational thumb nut for positioning the gliding channel section so that the gliding and non-gliding channel sections are in contact with the respective ladder stile. Each safety attachment incorporates a rocking section with a contact face that contacts the surface against which the ladder is placed during use and enables full face contact of the safety attachment over a range of angles between the ladder and the surface against which it rests during use.

18 Claims, 14 Drawing Sheets

(56) References Cited

U.S. PATENT DOCUMENTS

| | | | | |
|---|---|---|---|---|
| 4,395,030 | A * | 7/1983 | Eskuchen | B25B 1/125 269/181 |
| 4,582,306 | A * | 4/1986 | Sassenberg | B25B 1/2473 269/134 |
| 5,553,963 | A * | 9/1996 | Hoy | E06C 7/44 182/108 |
| 6,405,828 | B1 * | 6/2002 | Redding | E06C 7/48 182/107 |
| 6,619,644 | B1 * | 9/2003 | Liou | B25B 1/125 269/185 |
| 6,722,643 | B1 * | 4/2004 | Kurtz | B25B 5/10 269/249 |
| 7,997,839 | B1 * | 8/2011 | Gallegos | B60R 7/08 410/106 |
| 9,010,490 | B1 * | 4/2015 | Mosier | E06C 9/14 182/107 |
| 9,347,264 | B2 * | 5/2016 | Mosier | E06C 7/486 |
| 10,301,875 | B2 * | 5/2019 | Stout | E06C 7/48 |
| 2001/0047906 | A1 * | 12/2001 | Murray | E06C 7/486 182/214 |
| 2010/0038171 | A1 * | 2/2010 | Larard | E06C 7/50 182/107 |
| 2010/0038172 | A1 * | 2/2010 | Ralston | E06C 7/46 182/107 |
| 2010/0170748 | A1 * | 7/2010 | Robichaud | E06C 1/345 182/107 |
| 2014/0131532 | A1 * | 5/2014 | Elmore | E06C 7/188 248/201 |
| 2016/0208555 | A1 * | 7/2016 | Dehoff | E06C 7/48 |

* cited by examiner

COMBINATION OF TWO SAFETY ATTACHMENTS FOR LADDERS

CROSS-REFERENCE TO RELATED APPLICATION

This application is a continuation in part of U.S. patent application Ser. No. 14/876,559, filed Oct. 6, 2015.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION

For the purposes of this Specification the following definitions apply:

Ladder: A ladder is a single ladder, or an extension ladder, as commonly known in the construction industry and with do-it-yourself enthusiasts.

Ladder stiles: The upright portions of the ladder described above.

Most ladders are now made of aluminium or fibreglass and have varying sizes of ladder stiles.

Ladders are used extensively by a variety of trades in the construction industry and by individuals carrying out 'do it yourself' tasks in the home environment.

Ladders are generally fitted with pads at each end of each ladder stile to improve the contact between each ladder stile and the surface against which each ladder stile is landed during use.

Several accessories and safety features are commercially available to improve the contact stability at the top end and bottom end of ladder stiles when they are positioned against a work surface but ladders are often used for work where it is not practicable to land the top of the ladder stiles against the work surface and so a safety accessory is urgently required that will enable other points of each ladder stile to be securely landed on the surface where work is to be carried out. Such an accessory must be capable of being quickly and securely attached to each ladder stile to make the ladder a safer platform to work on.

The applicant is aware of patents regarding ladder attachments, clamps or vices that are currently available and could, or could theoretically, be attached to a ladder stile and possibly used as a safety attachment:

U.S. Pat. No. 2,591,900 04—1952 Whiteman; Benton A.
US-20030136227-A1 07—2003 Pliley; Larry E.

U.S. Pat. No. 4,226,144-A 10—1980 Pliley, Larry E.
US-0788716-A 05—1905 Hammond; R. A.
U.S. Pat. No. 6,543,192-B1 04—2003 Parker, Jr; Homer W.
U.S. Pat. No. 7,997,839-B1 08—2011 Gallegos; Dean L.
U.S. Pat. No. 5,553,963-A 09—1996 Hoy; Thomas A.
U.S. Pat. No. 4,709,178-A 11—1987 Burr; James D.
U.S. Pat. No. 5,765,902-A 06—1998 Love; Dale.
U.S. Pat. No. 7,310,864-B1 12—2007 Gingerich; Jake A.
U.S. Pat. No. 4,002,328-A 01—1997 Wolff; Robert.
U.S. Pat. No. 4,583,724-A 01—1977 Wolff; Robert.
U.S. Pat. No. 4,583,724-A 04—1986 Huang; Charles.
U.S. Pat. No. 1,507,815-A 09—1924 Cumner; Matthews.
U.S. Pat. No. 1,665,170-A 04—1928 Larsen; O. C.
U.S. Pat. No. 2,100,513-A 11—1937 Mershon; Lester E.
U.S. Pat. No. 2,383,170-A 08—1945 Stoll; Henry C.
U.S. Pat. No. 4,341,375-A 07—1982 Romanin; Mario.
U.S. Pat. No. 5,172,895-A 12—1992 Klimach; Horst.
U.S. Pat. No. 4,418,899-A 12—1983 Zimmermann; Hanns.
US-20070007704-A1 01—2007 Hooper; Ronald L.
U.S. Pat. No. 3,223,407-A 12—1965 Wills; M.
U.S. Pat. No. 6,406,012-B1 06—2002 Guo; Shuenn Jyi.
U.S. Pat. No. 4,262,892-A 04—1981 Wu; Rong Chun.
U.S. Pat. No. 7,036,807-B1 05—2006 Gasparyan; Karen.
U.S. Pat. No. 2,269,381-A 01—1942 Robertson; J. W.
U.S. Pat. No. 3,853,202-A 12—1974 Jarboe deceased; Alfred J.
US-20020134619-A1 09—2002 Schwenke; Donald R.
U.S. Pat. No. 9,010,490-B1 04—2015 Mosier; Tim.
U.S. Pat. No. 4,062,519-B1 06—2002 Redding; William A.
U.S. Pat. No. 8,616,335-B1 12—2013 Mosier; Tim.
U.S. Pat. No. 4,062,519-A 03—2007 Jacobs Lawrence O'Quinn
U.S. Pat. No. 9,593,532-B2 03—2017 Dehoff; Clifford B.
U.S. Pat. No. 3,131,900-A 05—1964 Anderson; Robert J.
US-20060054390-A1 03—2006 Ray Stephen Win.

U.S. Pat. No. 3,131,900-A 05—1964 Anderson; Robert J device is a screw threaded rod fixed to a non-gliding channel section having a thumb nut being held captive between a non-gliding channel section and the end of the rotating screw threaded rod retaining section. This attachment would not provide the ease of use that the present invention provides.

U.S. Pat. No. 1,507,815-A 09—1924 Cumner; Matthews invention is a cast rocking section with a pintle connection. The device of Cumner appears heavy and cumbersome and would require much strength to attach to a ladder stile and so could not be used as a ladder safety attachment as it would be too heavy in relation to the use of the ladder and could not be attached to a ladder stile safely.

U.S. Pat. No. 4,002,328-A 01—1997 Wolff; Robert invention is a rotating threaded rod to adjust the gliding section which is held in place by two parallel rods with no threading. However, the screw threaded rod of Wolff's invention is not fixed, for if it was it would not rotate. The screw threaded rod of Wolff's invention does not pass through the anti-distortion flanged tube nor does the screw threaded rod of Wolff's invention provide the glide guide for the gliding channel section as this is achieved by two parallel bars. The screw threaded rod of Wolff's invention does not pass through the gliding channel section, and the jaws of Wolff's cramp is not suited for a safe attachment to a ladder stile and therefore it could not be fitted to a ladder stile using only one hand.

US-20030136227-A1 07—2003 Pliley; Larry E invention is a rotating screw threaded rod and a gliding channel section wherein the screw threaded rod does not pass through the gliding channel section, nor does the screw threaded rod provide a glide guide for the gliding channel section.

For the reasons given it is unlikely that any of the prior inventions could be practicably evolved to become suitable safety attachment for ladders nor could they be safely attached to, or removed from, a ladder stile quickly and by using one hand.

Working from ladders is a fundamental health and safety issue and continuous improvement in ladder safety is an ongoing requirement. To encourage user participation in improving safe working with ladders it is important to provide ladder safety attachments which are small, lightweight, versatile, non complex, affordable, easily stored, simple to use, can be fitted and removed to virtually any ladder quickly and provide greater stability by using deformable materials which will deform to the shape of the contact surface, giving improved sideways and downward grip and making the ladder safer to climb. It is also desirable to provide a safety attachment that has a rocking section with a contact face wherein the rocking section can be either locked parallel to the ladder stile to suit surfaces like a sharp edge, scaffolding bar or a window sill or unlocked to suit a flat surfaces like a wall that the safety attachment and ladder stiles might be placed during use.

OBJECTIVE OF THE PRESENT INVENTION

The invention is based on the objective of creating an assembly comprising two safety attachments for attaching to the stiles of a ladder and to make a ladder a much safer platform to work from.

DESCRIPTION OF THE PRESENT INVENTION

The two safety attachments are a right handed safety attachment and a left handed safety attachment. The configuration of each right handed safety attachment and each left handed safety attachment allows a person to attach and remove each safety attachment quickly.

Wherein the left handed safety attachment and the right handed safety attachment of the present invention each comprise at least:

A gliding channel section preferably having deformable material with cushioning properties, five visible punched, moulded or brake pressed folded bends, apertures, a strengthening configuration and a hollow anti-distortion flanged tube having no threading and optional flared ends (31).

A non-gliding channel section preferably having a main body, a base, a fixed screw threaded rod, five visible punched, moulded or brake-pressed folded bends, a screw threaded rod fixing platform, a screw threaded rod retaining section, three centrally located apertures one of which is large and rectangular in shape (24) to accommodate rotation of a rotational thumb nut, one of which apertures is located on the screw threaded rod fixing platform and one of which is located in the screw threaded rod retaining section, and a deformable material with cushioning properties.

A screw threaded rod preferably having a top end, a bottom end, a middle portion, the hollow anti-distortion flanged tube having no threading, a fixing means, a first and a second locking nut and the rotational thumb nut.

A base having three visible punched, molded or brake-pressed folded bends, a pintle connection and three apertures, one of which apertures provides a latch keeper.

A rocking section having three visible punched, molded or brake-pressed folded bends, three apertures one of which apertures accommodates a latch, a pin, pin retainers, a contact face, a pintle connection and deformable material with cushioning properties.

With regards to each gliding channel section:

It is important to understand that the strengthening configuration (22) of the gliding channel section serves more than one purpose. Firstly, it strengthens and provides apertures (23) for the fixing of the hollow anti-distortion flanged tube with no threading, providing the general strength of the gliding channel section. Secondly, it provides alignment of the hollow anti-distortion flanged tube with no threading in relation to the screw threaded rod and determines the alignment of the gliding channel section in relation to the non-gliding channel section, wherein the screw threaded rod maintains a central position in relation to the centre of the hollow anti-distortion flanged tube with no threading, wherein the inner surface of the hollow anti-distortion flanged tube with no threading has little or minimal contact with the threading of the screw threaded rod and therefore will move freely on the screw threaded rod.

With regards to each non-gliding channel section:

It is important to note that there is a central aperture on the screw threaded rod fixing platform on the non-gliding channel section to accommodate the fixing of the screw threaded rod. There is also a central aperture on the screw threaded rod retaining section. The non-gliding channel section has a flat area on its outside surface between the fixing platform and the large rectangular shaped central aperture on the non-gilding channel section. This flat clear area provides a suitable flat surface for other attachments that may be attached to the non-gliding channel section.

With regards to each screw threaded rod:

It is important to understand that the screw threaded rod is encompassed by the hollow anti-distortion flanged tube with no threading, the rotational thumb nut, the locking nuts, the screw threaded rod fixing platform and the screw threaded rod retaining section.

With regards to each base:

It is important to understand that the base is fixed to the non-gliding channel section in close proximity to the screw threaded rod fixing platform and opposed to the screw treaded rod retaining section and that one of the three apertures is larger to accommodate the latch keeper, the two remaining apertures providing for pintle connections.

With regards to each the rocking section:

It is important to understand that one of the rocking section's three apertures is larger to provide for the latch to engage with the latch keeper on the base section. Each of two remaining apertures will provide for each of the pintle connections. The rocking section is formed larger than the base wherein the base will fit inside the rocking section with minimum clearance between each side wherein the rocking section will move freely on its pintle connection.

The present invention can easily and quickly be fitted or removed by one hand to either the fly section or the base section of most extension ladders, even when those ladder sections are stored together.

DETAILED DESCRIPTION OF THE PRESENT INVENTION

Although not limited, and may be altered at the discretion of an ordinary person skilled in the art, the preceding embodiments, assembly and workings of each right handed safety attachment and each left handed safety attachment are described in conjunction with the accompanying drawings.

Once the base (15) has been fitted off centre to the screw threaded rod retaining section (9) and in close proximity to the screw threaded rod fixing platform (10) of the fixed non-gliding channel section (6), and prior to the fixing of the screw threaded rod (3) at its desired position on the screw threaded rod fixing platform (10) on the fixed non-gliding channel section (6), a receptively threaded thumb nut (4) is threaded onto the screw threaded rod (3) at approximately two inches from the top end of the screw threaded rod (3). The bottom end of the screw threaded rod (3) is entered into, and passes through without restriction, the hollow anti-distortion flanged tube (5) which is attached to the gliding channel section (8). A first locking nut (1) is then threaded onto the bottom end of the screw threaded rod (3) approximately five-eighths of an inch from the bottom end of the screw threaded rod (3). The top end of the screw threaded rod (3) is then passed into, and through, a central aperture (26) on the screw threaded rod retaining section (9) opposed to the base (15) of the fixed non-gliding channel section (6) and screw threaded rod fixing platform (10). The remaining threaded portion at the of the bottom end of the screw threaded rod (3) is then passed into, and protrudes through, the central aperture (11) on the screw threaded rod fixing platform (10) of the fixed non-gliding channel section (6). Once the bottom end of the screw threaded rod (3) is through the aperture (11) on the screw threaded rod fixing platform (10) a second locking nut (2) is tightened and locked onto the remaining threads of the screw threaded rod (3) that are protruding through the screw threaded rod fixing platform (10), thus sandwiching the screw threaded rod (3) on the screw threaded rod fixing platform (10) between the first locking nut (1) and the second locking nut (2). There may be other means of fixing the screw threaded rod (3). The screw threaded rod (3) is now fixed in its position on the fixed non-gliding channel section (6) rendering the fixed screw threaded rod (3) immobile. The fixed screw threaded rod (3) will now provide a glide guide for the gliding channel section (8). The gliding channel section (8) can move freely on the fixed screw threaded rod (3) between the thumb nut (4) and the first locking nut (1) at the screw threaded rod fixing platform (10). The thumb nut (4) can be rotated either clockwise or anticlockwise to set it at any position linearly on the fixed screw threaded rod (3) between the fixed screwed threaded rod retaining section (9) and the hollow anti-distortion flanged tube (5) which is incorporated in the gliding channel section (8). Linear movement of the rotating thumb nut (4) can then be used to set the position of the gliding channel section (8) relative to the first locking nut and the various ladder stile sizes.

The base (15) which has been fixed to the fixed non-gliding channel section (6) has three apertures, two of them being off centre apertures for a pintle connection (12) to accommodate the attachment of the rocking section (16) to the base (15). The base (15) further has two angle cut offs (18) to determine the angle of pitch, and movement, of the rocking section (16) thus enabling the contact face of the safety attachment rocking section (16) to be in contact with the surface against which the ladder stile is placed over a range of angles. The orientation of the two angle cut offs (18) and the latch keeper (19) on the base (15) of the fixed non-gliding gliding channel section (6) will determine the handing of the safety attachment.

To attach the rocking section (16) to the base (15) of the fixed non-gliding channel section (6) the rocking section (16) is orientated so that it's latch (14) is in line with the latch keeper (19) on the base (15) of the fixed non-gliding channel section (6) and the pintle apertures (20) in the rocking section (16) are in line with pintle apertures (21) on the base (15). A pin (12) is entered into, and passed through, the apertures (20) on the outer sides of the rocking section (18) and the corresponding apertures (21) on the outer sides of the base (15) until the pin (12) is protruding through both sides of the rocking section (16). Once the pin (12) is in place, pin retainers (13) are fitted to the protruding portions of the pin (12) to retain the pin in position.

The operation required to attach the safety attachment to the ladder stile is achieved by clockwise rotation of the thumb nut (4) on the fixed screw threaded rod (3) until the thumb nut (4) comes into contact with the flange plate (29) of the hollow anti-distortion flanged tube (5) incorporated in the gliding channel section (8). The final and firm attachment of the safety attachment to the ladder stile is achieved with further rotation of the thumb nut (4) locking it tightly against the flange plate (29) of the anti-distortion flanged tube (5) of the gliding channel section (8). This provides the clamping, tight and safe attachment of the safety attachment to the ladder stile.

The unlocking and removal of the safety attachment from the ladder stile is achieved by rotating the thumb nut (4) in an anti-clockwise direction to remove the pressure of the thumb nut (4) from against the flange plate (29) of hollow anti-distortion flanged tube (5) of the gliding channel section (8). Each turn of the thumb nut (4) in an anti-clockwise direction will enable greater free movement of the gliding channel section (8) on the fixed screw threaded rod (3) until the gliding channel section (8) can be freely moved back along the fixed screw threaded rod (3). The safety attachment can then be removed from the ladder stile. All operations relating to the attachment and removal of the safety attachment can be performed using only one hand.

The separation between the gliding channel section (8) and fixed non-gliding channel section (6) can be varied by one handed rotation of the thumb nut (4) on the fixed screw threaded rod (3). This range of separation will accommodate a range of ladder stile sizes.

Not limited:

The present invention can be easily fitted to, or removed from, the fly section or the base section of most extension ladders using one hand even when those ladder sections are stored together. Each safety attachment can be attached to any area of the ladder stile from the top to the bottom.

For any person skilled in the art it would be obvious that the non-gliding channel section (6) of the safety attachment has an area on the outer surface (17) with the option to be fitted with other connections; for example a hollow tubular attachment (27) or hollow box like member could be attached to the outer surface. This would accommodate other receptive members and therefore be obvious to someone skilled in the art that they could attach a variety of accessories to any member being attached to non-gliding channel section (6). For example, an arm like member (28) with a fixing means (30) to stabilize the bottom of a ladder. This would require the safety attachment to be attached to the ladder stile closer to the bottom of the ladder wherein any attached arm like member (29) would be in contact with the ground. This would prevent the ladder from slipping or twisting at its bottom. The hollow anti-distortion flanged tube with no threading (5) may be substituted with another hollow member or an inner sleeve. This would be obvious to someone skilled in the art as it may smooth the gliding action on the screw threaded rod (3). The non-gliding channel section (6) and gliding channel section (8) are both preferably provided with a deformable material with cushioning properties (7). Furthermore, anyone skilled in the art would know that the gliding channel section (8) and the non-gliding channel section (6) can be configured not only to have the ability to mate with, and attach to, a ladder stile but can also be configured to mate with, and attach to, a cylindrical object as this would entail curving the member of the gliding channel section and the non-gliding channel section where the deformable materials (7) are disposed. For instance, the attachments could be configured to attach to a pole or scaffolding bar. Someone skilled in the art will know that the fixed screw threaded rod (3) may comprise another fixing method at the screw threaded rod fixing platform (10) and the rotational thumb nut (4) may be a quick release thumb nut which would substitute the rotational thumb nut (4) as this would reduce time when operating the safety attachments. However, this arrangement would add to the overall expense in production of the safety attachments and the safety implications would override the benefits. The limitations of attachments that can be fitted to the non-gliding channel section (6) would be at the discretion of anyone skilled in the art.

The safety attachments reduce both sideways and downward slippage of a ladder when resting against a range of surfaces and will reduce the number of fatal falls and accidents involving ladders.

These features and advantages will become apparent to ladder users upon perusal of the following descriptions read in conjunction with the accompanying drawing figures and appended claims.

SEQUENCE LISTING

Figure 1:
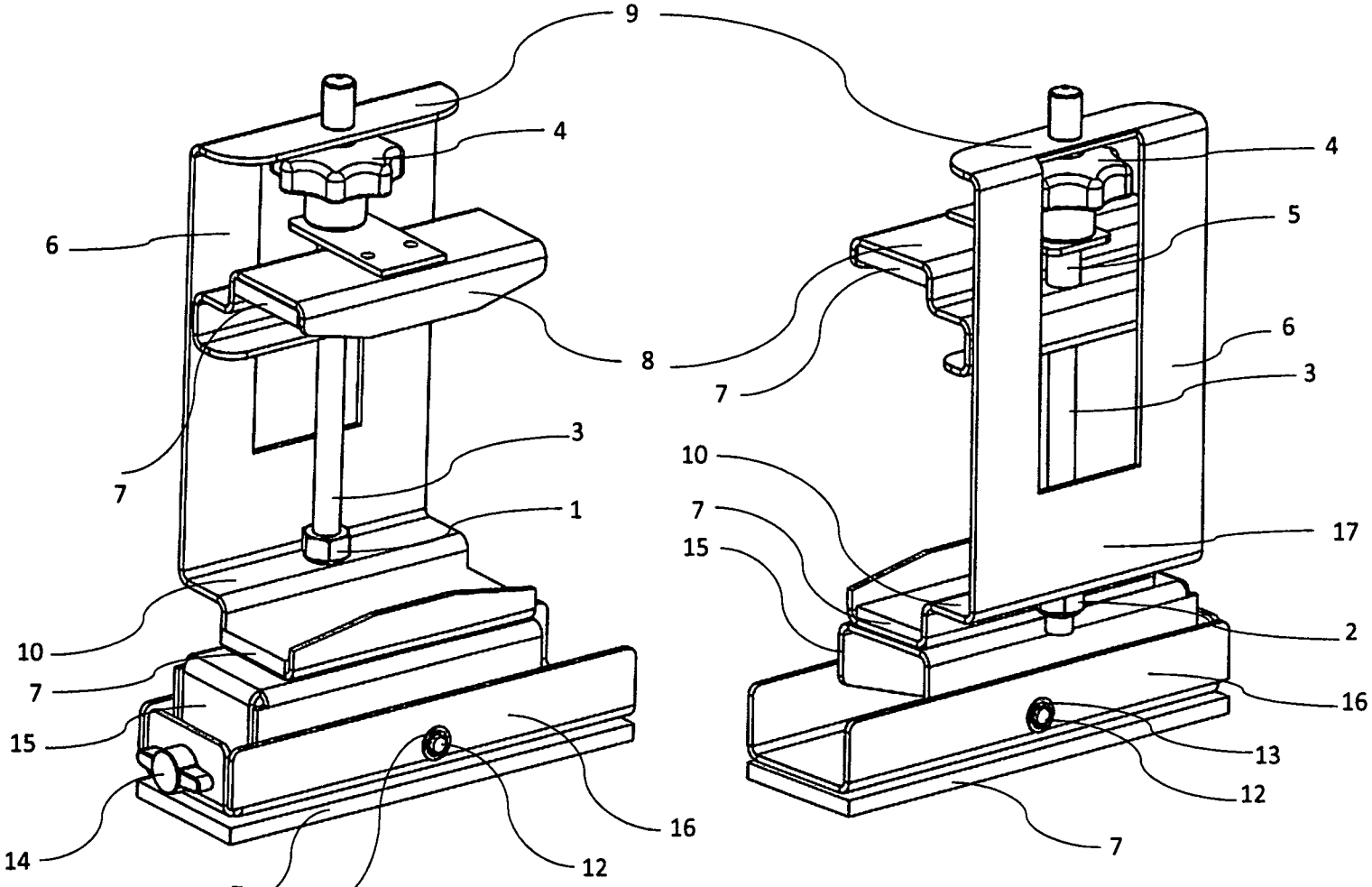
FIG. 1 shows front and rear perspective views of a left handed safety attachment wherein all sixteen mentioned visible bends of a left handed safety attachment can be understood.
Figure 2:
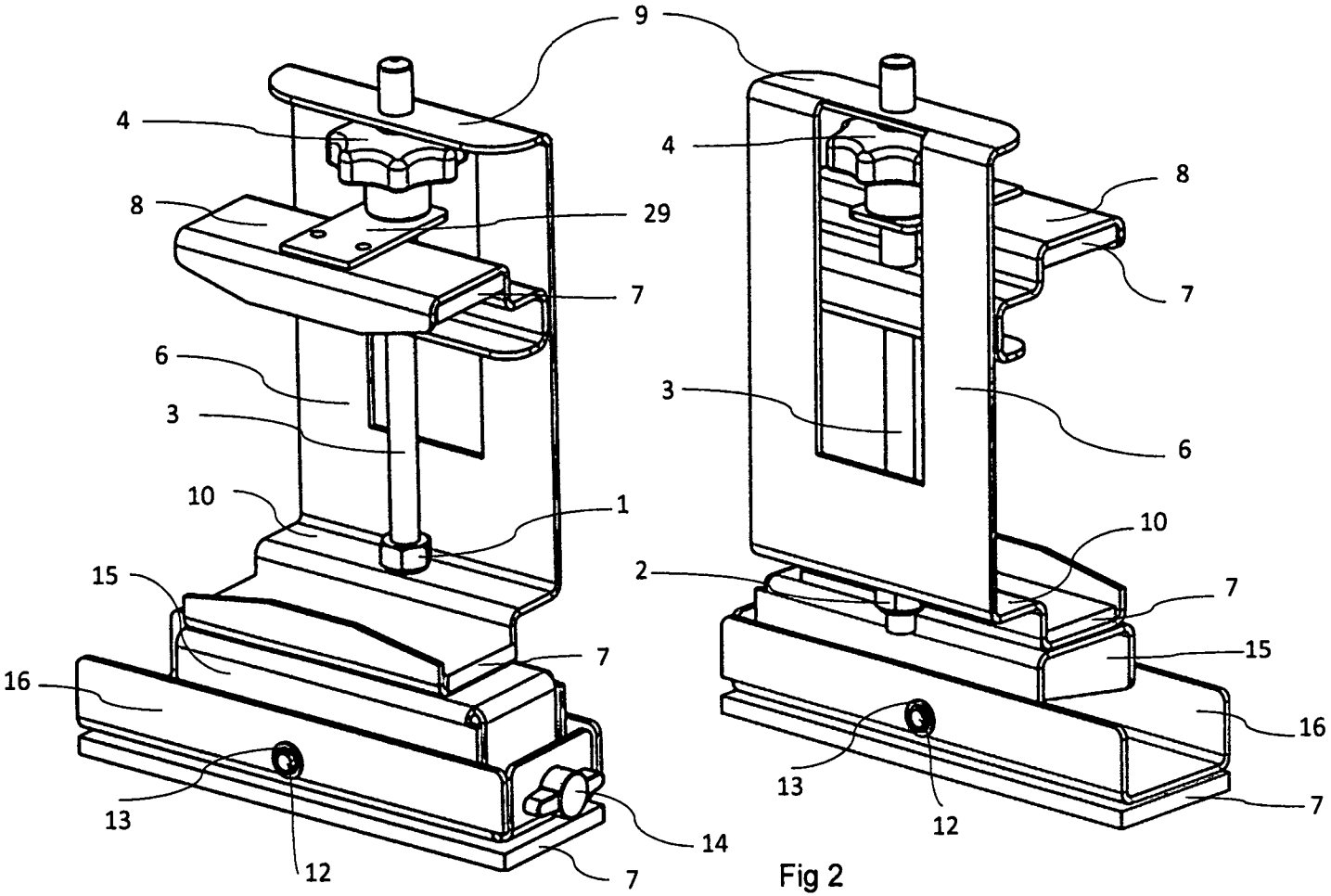
FIG. 2 shows front and rear perspective views of a right handed safety attachment wherein all sixteen mentioned visible bends of a right handed safety attachment can be understood.
Figure 3:
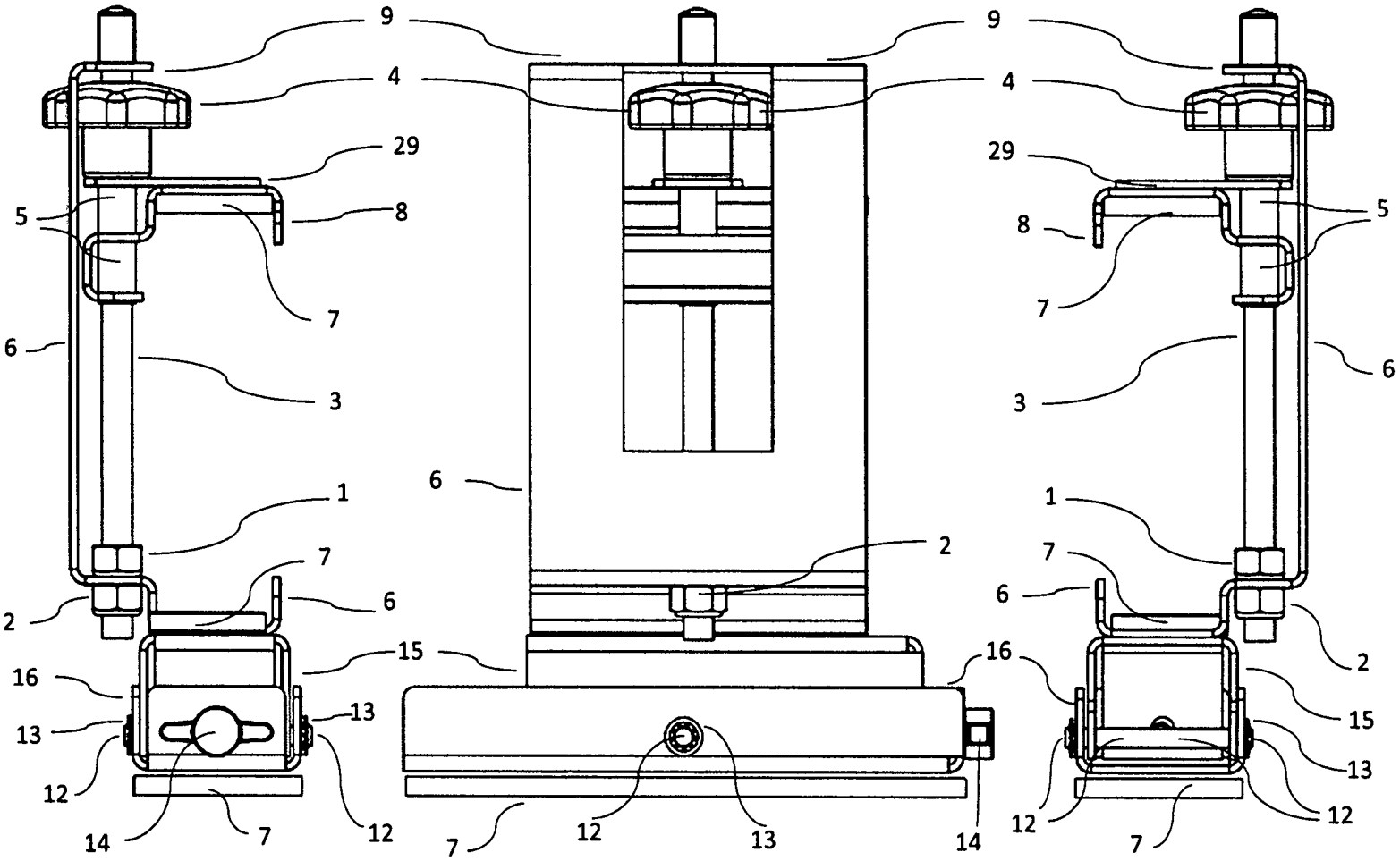
FIG. 3 shows the rear, inside and front elevations of a left handed safety attachment.
Figure 4:
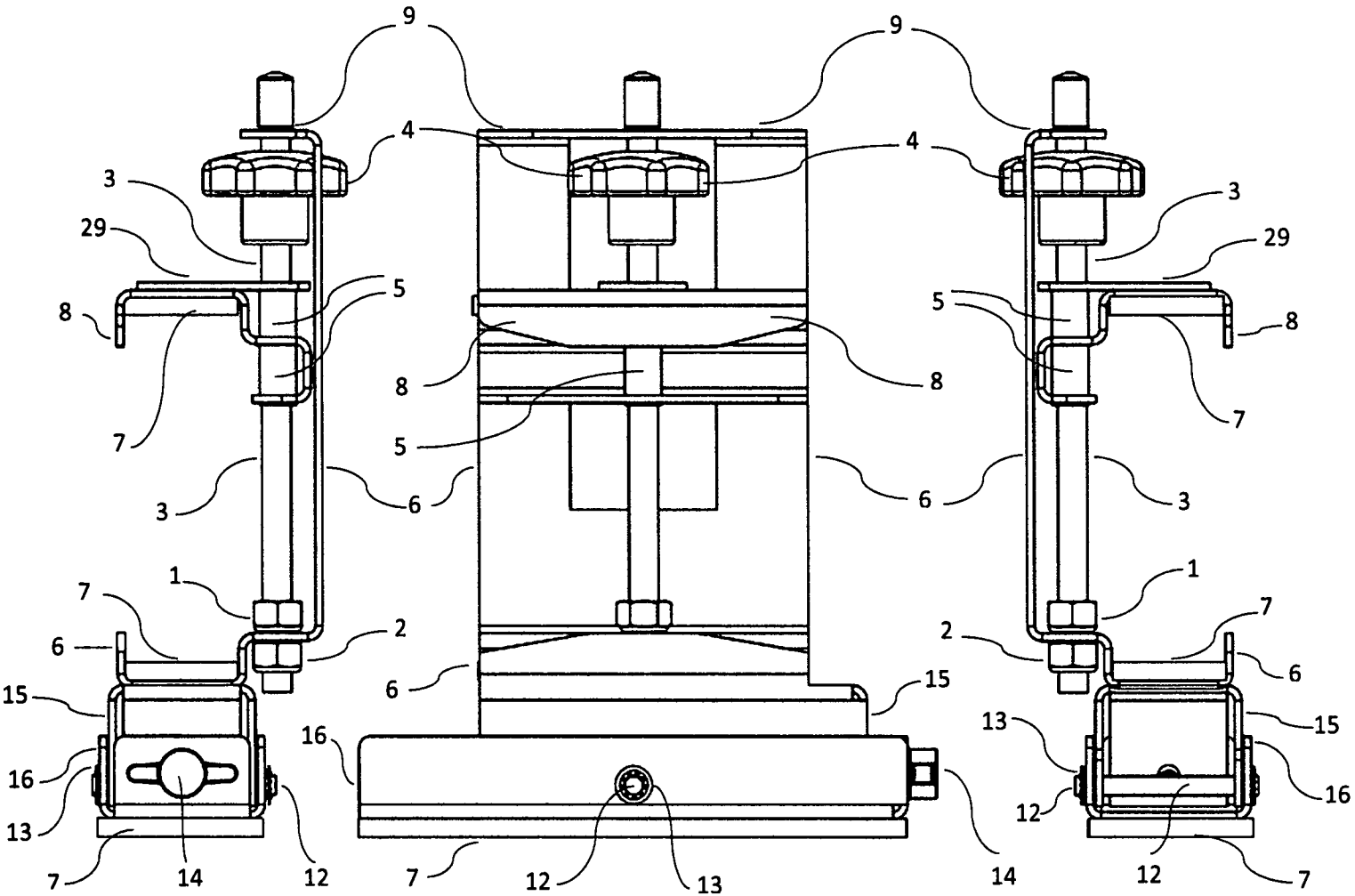
FIG. 4 shows the rear, inside and front elevations of a right handed safety attachment.
Figure 5:
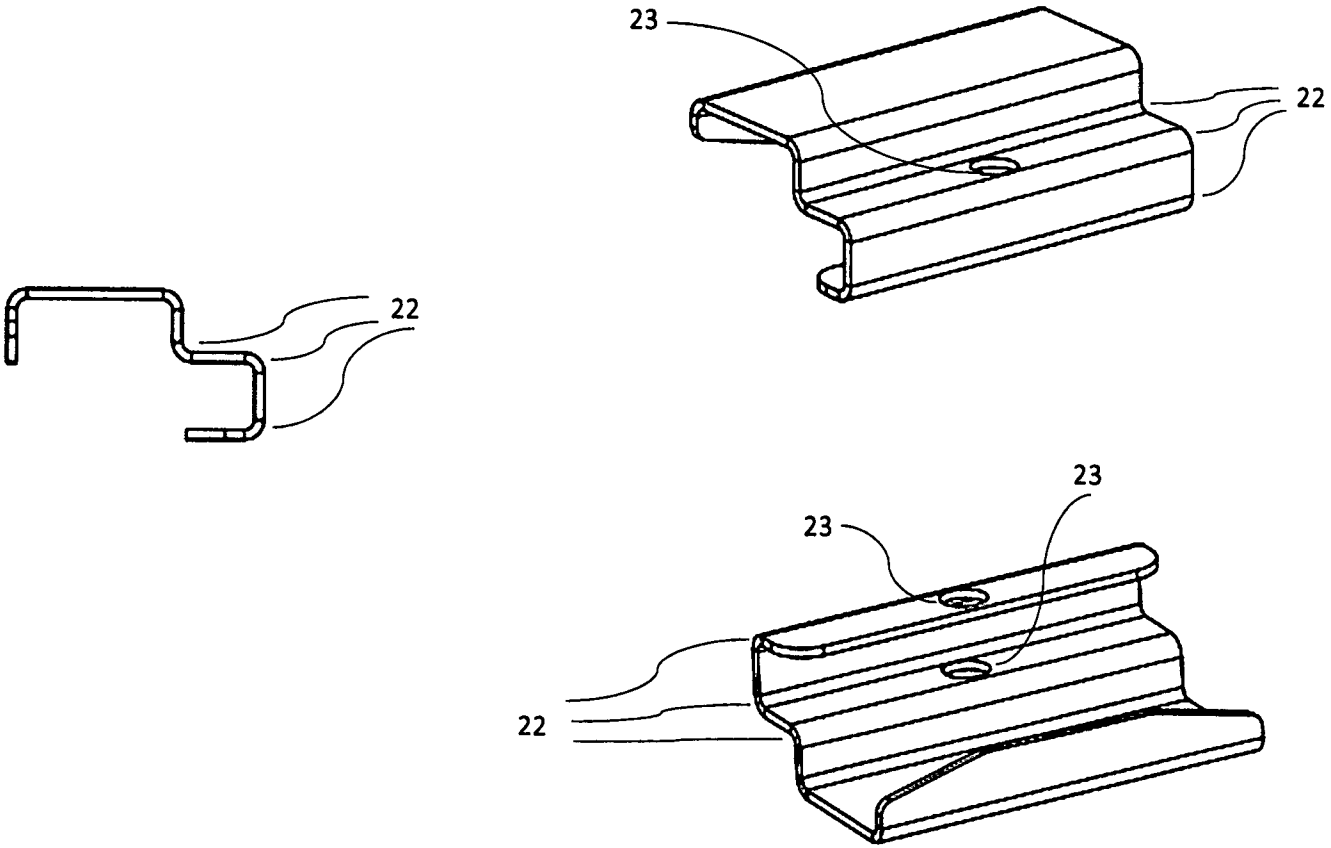
FIG. 5 shows perspective views and end elevation of a gliding channel section showing the apertures and strengthening configuration.
Figure 6:
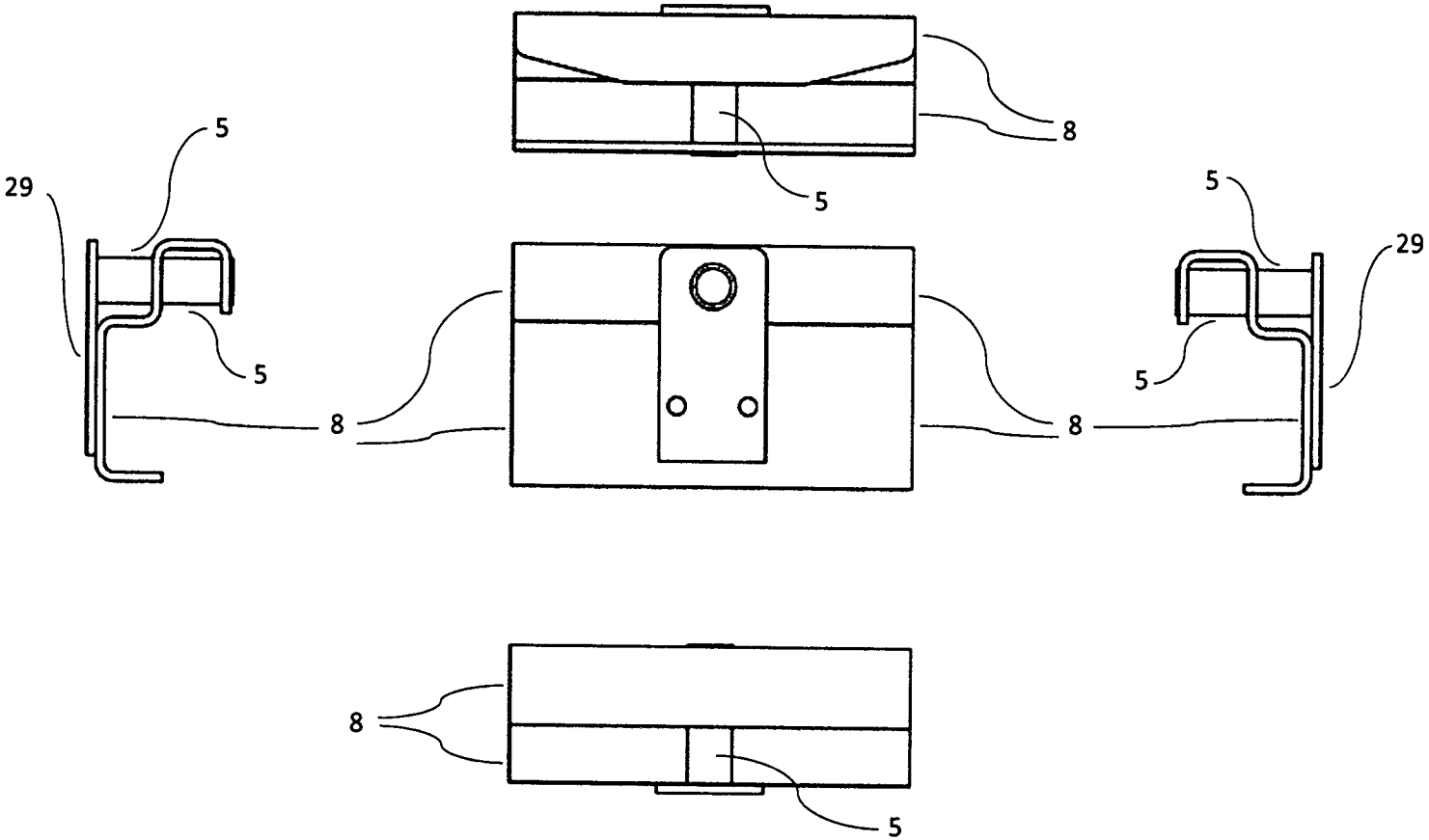
FIG. 6 shows top elevation, bottom elevation and end elevations of a gliding channel section fitted to the anti-distortion flanged tube without threading.
Figure 7:
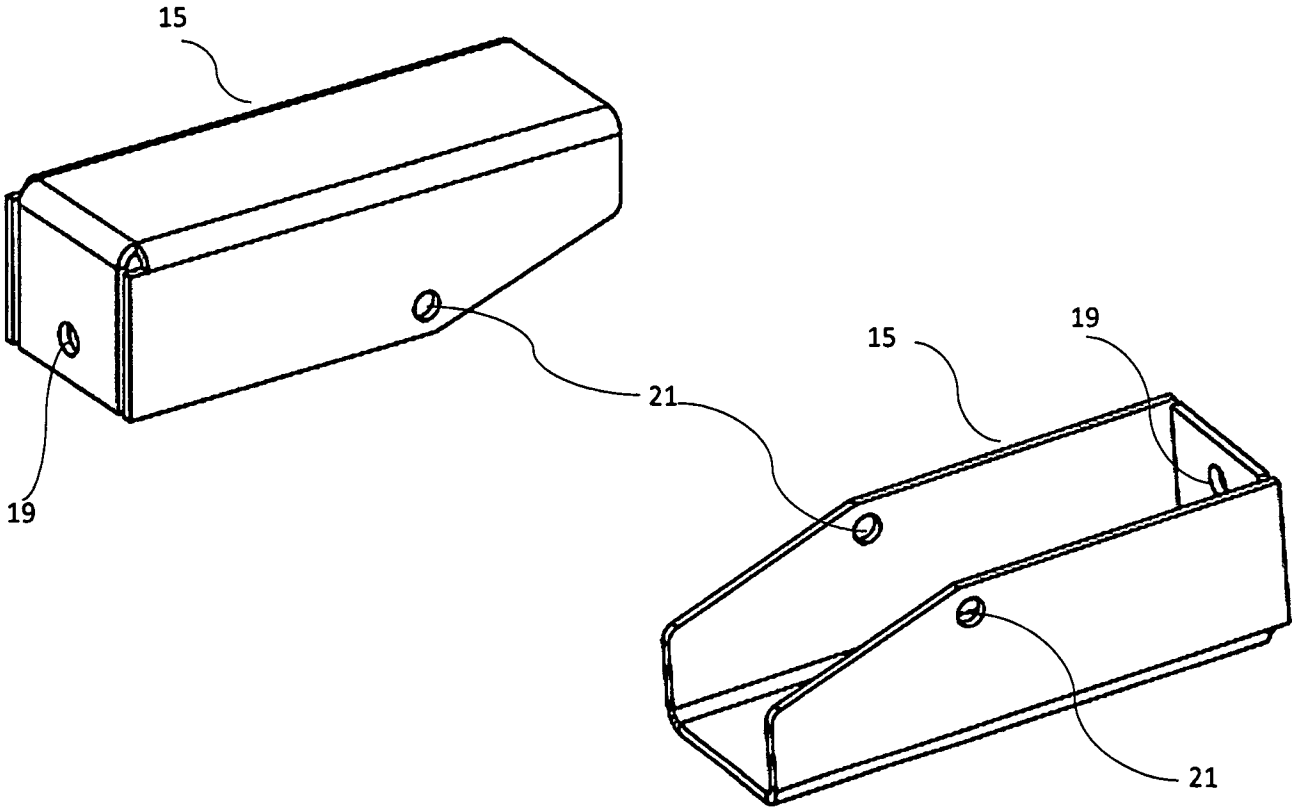
FIG. 7 shows perspective views of a base section with angle cut offs and apertures for pintle connection and latch keeper.
Figure 8:
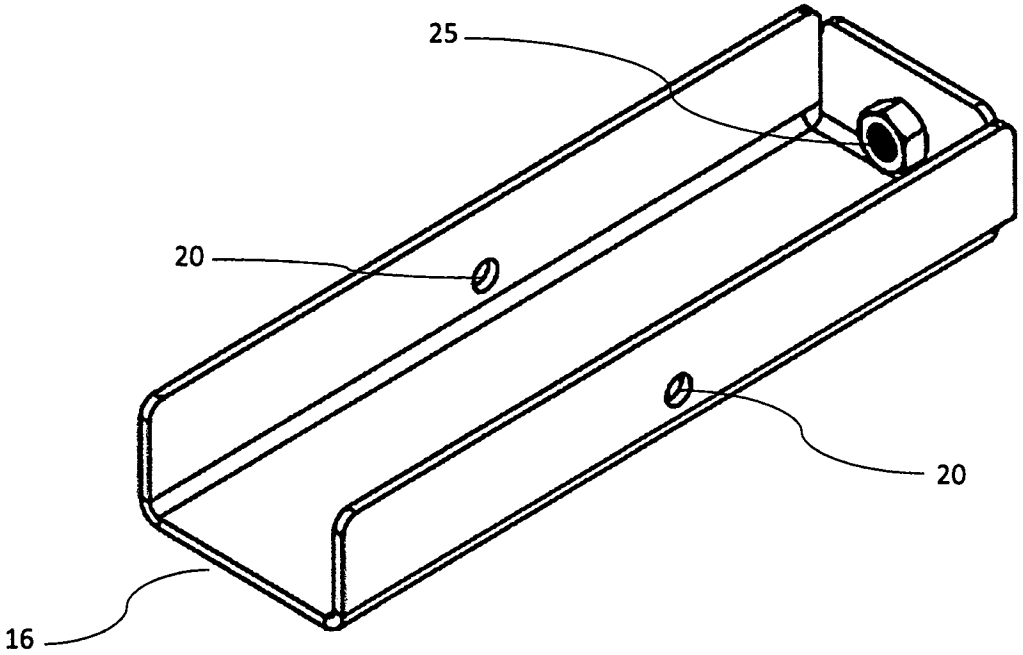
FIG. 8 is a perspective view of the rocking section showing the latch aperture and pintle connection apertures.
Figure 9:
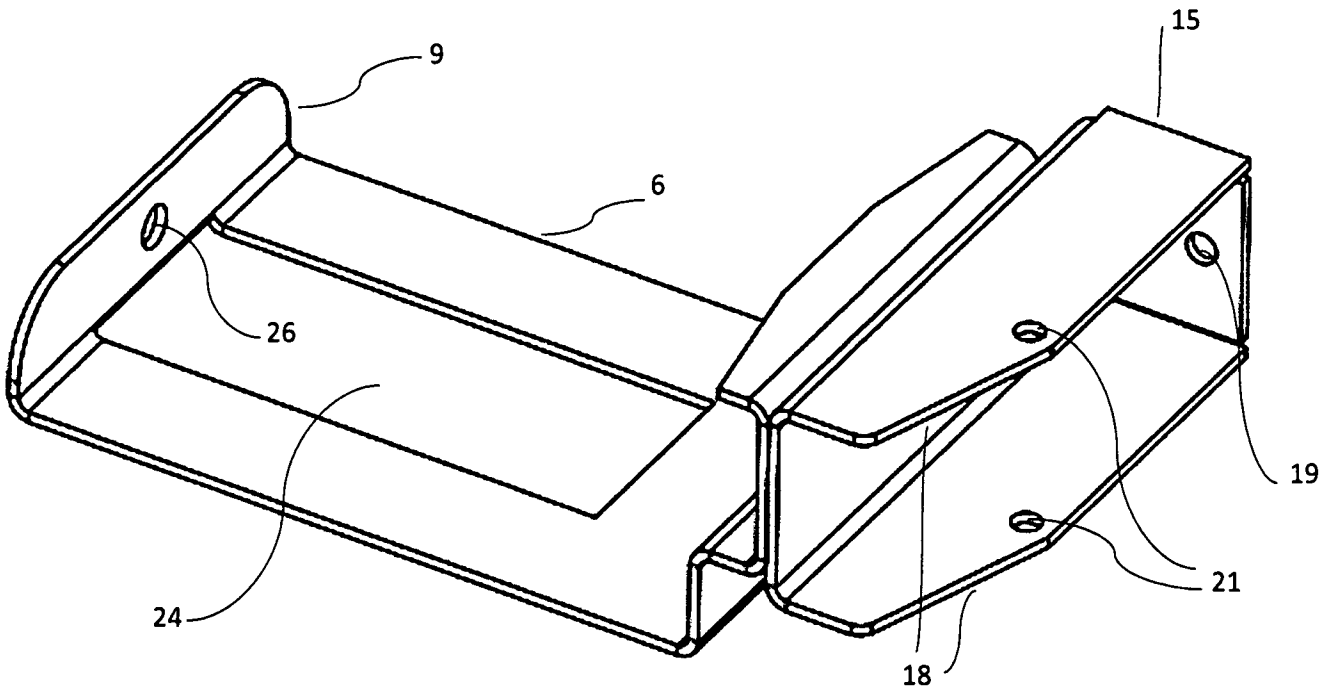
FIG. 9 is a perspective view of a right handed non-gliding channel section showing the base fixed in place, large rectangular aperture and the screw threaded rod retaining section with its central aperture.
Figure 10:
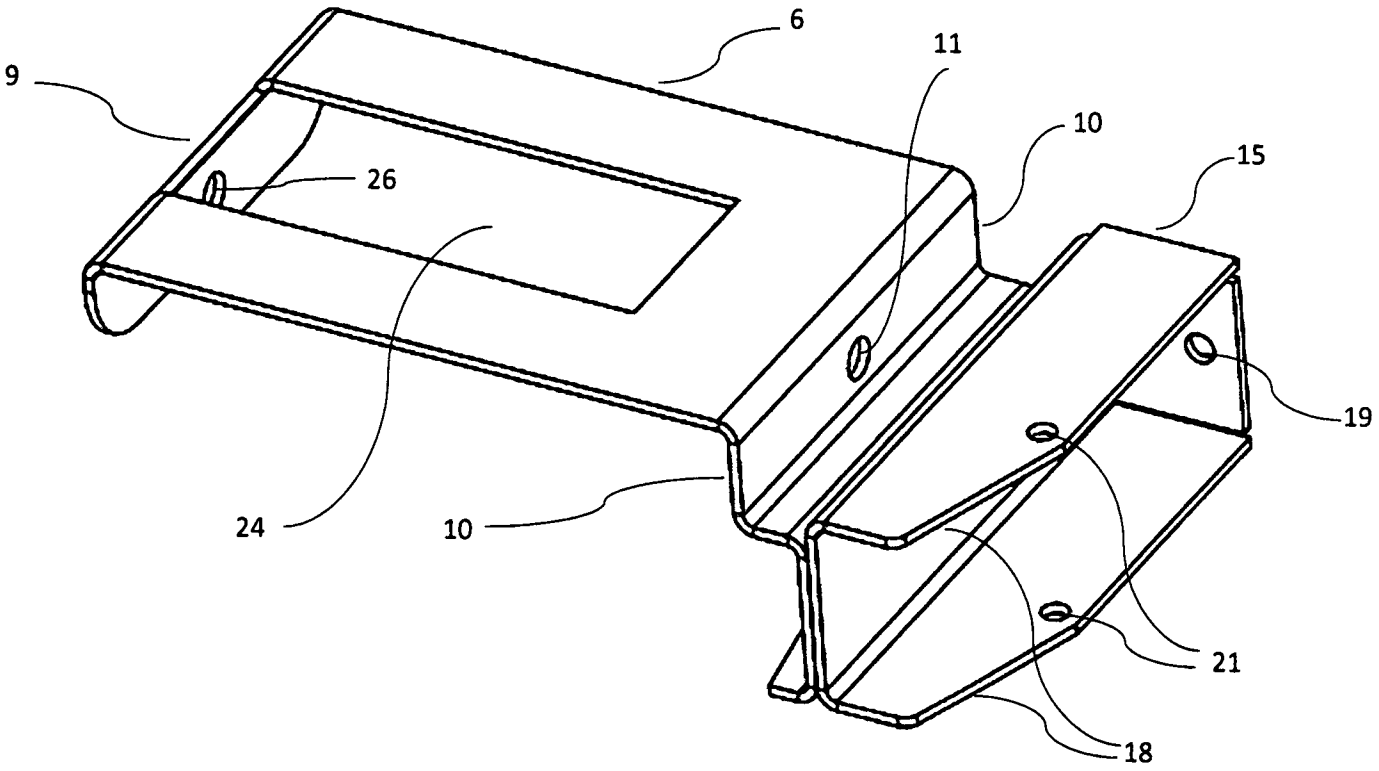
FIG. 10 is a perspective view of a left handed non-gliding channel section showing the base fixed in place, large rectangular aperture and the screw threaded rod retaining section with its central aperture.
Figure 11:
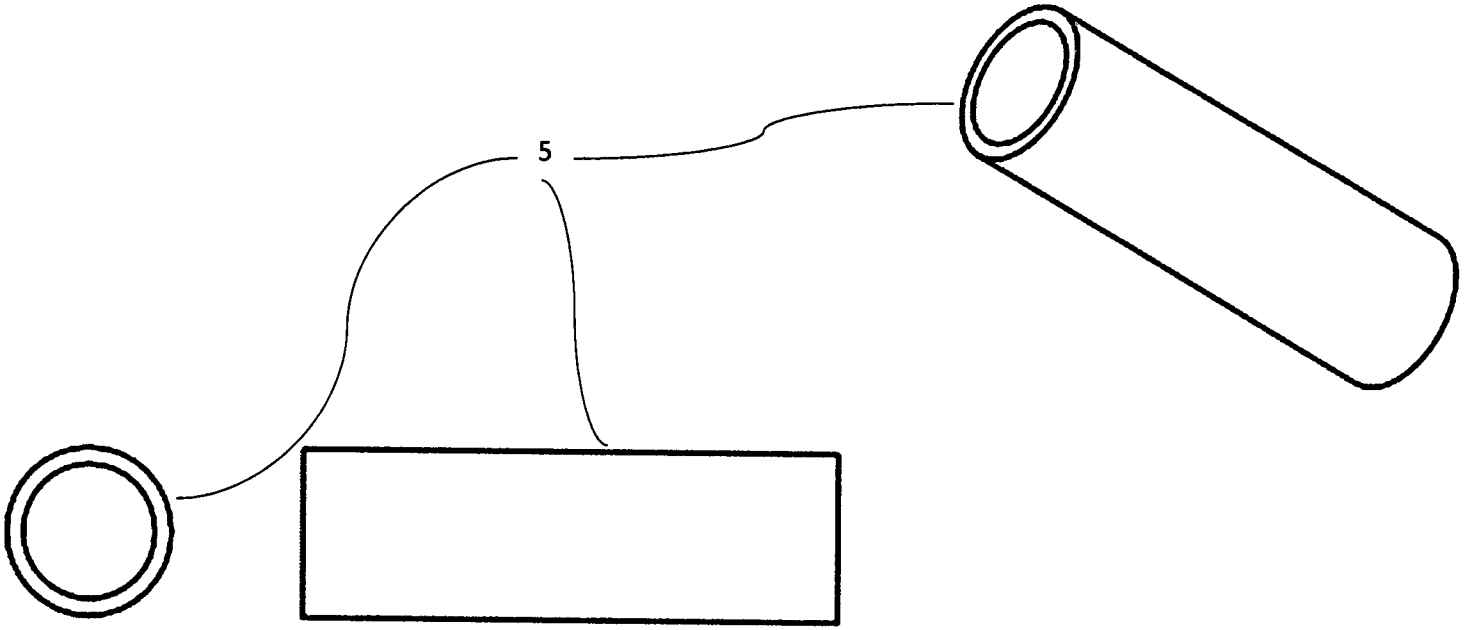
FIG. 11 shows end and side elevations, and a perspective view, of an anti-distortion flanged tube without threading with its flared ends (31) still to be flared.
Figure 12:
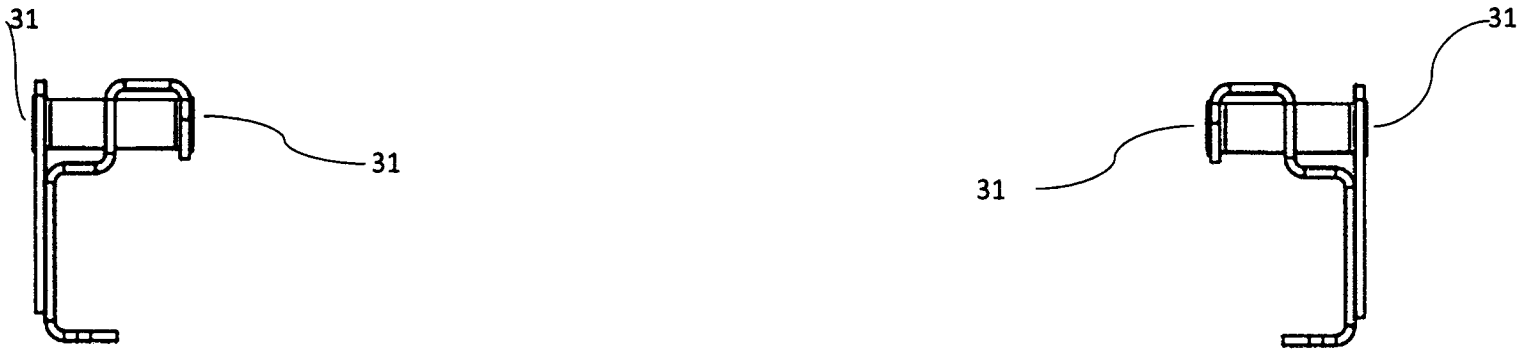
FIG. 12 is an end elevation of a gliding channel section showing the flared ends of the anti-distortion flanged tube.
Figure 13:
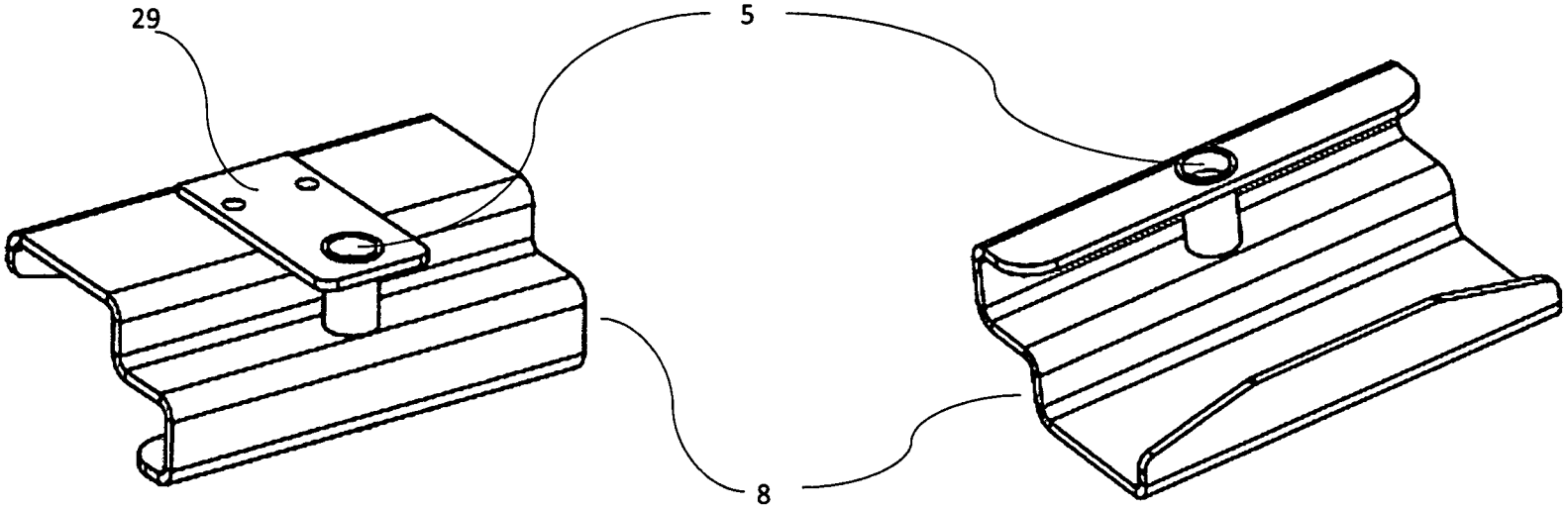
FIG. 13 is a perspective view of a gliding channel section and anti-distortion flanged tube with flared ends.
Figure 14:
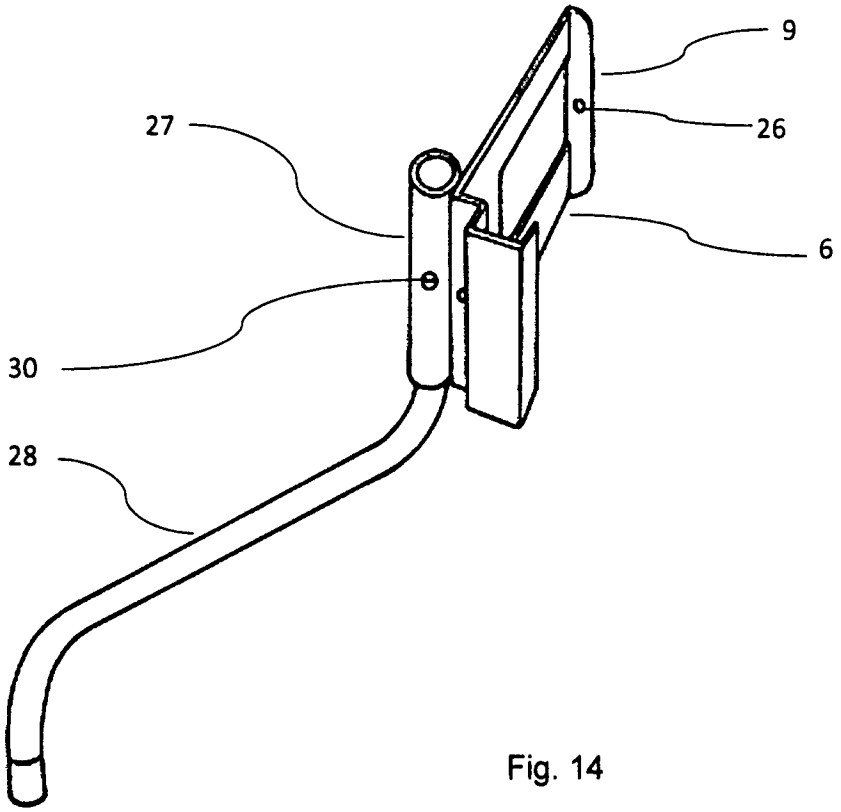
FIG. 14 shows a reduced scale perspective view of a non-gliding channel section with attachment for an arm member with its fixing means.

Not Applicable.

The invention claimed is:

1. An assembly comprises two safety attachments for a ladder, each of said two safety attachments being formed for attaching to a respective ladder stile, said two safety attachments comprising one left handed safety attachment and one right handed safety attachment, each said left handed safety attachment and each said right handed safety attachment further comprising:

a non-gliding channel section comprising five visible brake-pressed folded bends, three of said five visible brake-pressed folded bends at one end being configured to mate to said respective ladder stile, another one of said five visible brake-pressed folded bends forming a screw threaded rod fixing platform receiving a bottom end of a screw threaded rod, and a final one of said five visible brake-pressed folded bends forming a screw threaded rod retaining section at a second end of said non-gliding channel section for retaining of a top end of said screw threaded rod;

a gliding channel section comprising a hollow flanged tube with no threading, five visible brake-pressed folded bends and two apertures, two of said five visible brake-pressed folded bends being configured to mate with said respective ladder stile, another three of said five visible brake-pressed folded bends forms a strengthening configuration, wherein said strengthening configuration and the two apertures provide a connection for said hollow flanged tube, said strengthening configuration also provides central alignment of said hollow flanged tube in relation to said screw threaded rod, and said screw threaded rod having a middle portion between said top end and said bottom end, said screw threaded rod thereby being encompassed by said screw threaded rod fixing platform, said screw threaded rod retaining section, said hollow flanged tube, and a rotational thumb nut, a first locking nut and a second locking nut;

a base, wherein said base being fixed to said non-gliding channel section in close proximity to said screw threaded rod fixing platform and opposed and centrally offset in relation to said screw threaded rod retaining section, said base comprising three visible brake-pressed folded bends, a first aperture, a second aperture, a third aperture, and two angle cut offs;

a rocking section, the rocking section having a contact face having a deformable material with cushioning properties, three visible brake-pressed folded bends, a first aperture, a second aperture and a third aperture, wherein said first aperture and said second aperture receive a pin thereby forming a pintle connection between said rocking section and said base, said two angle cut offs configured to limit the angle of pitch and movement of the rocking section relative to said base.

2. The assembly of claim 1, said pin received by said first aperture and said second aperture of said rocking section penetrating through said first aperture and said second aperture of said base, whereby portions of the pin protruding beyond said first aperture and said second aperture of said rocking section are provided with pin retainers to retain said pin.

3. The assembly of claim 1, wherein said non-gliding channel section further comprises a first centrally located aperture, a second centrally located aperture and a third centrally located aperture, wherein said third centrally located aperture is a large rectangular shape, said first centrally located aperture being located on said screw threaded rod retaining section, said second centrally located aperture being located on said screw threaded rod fixing platform.

4. The assembly of claim 3, wherein said first centrally located aperture located on said screw threaded rod retaining section being opposed and central to said second centrally located aperture located on said screw threaded rod fixing platform.

5. The assembly of claim 1, wherein the bottom end of said screw threaded rod being fixed to said screw threaded rod fixing platform by said first locking nut and said second locking nut, with said top end of said screw threaded rod being retained in said screw threaded rod retaining section, whereby the assembly will render said screw threaded rod fixed and immobile.

6. The assembly of claim 3, wherein said third centrally located aperture of said non-gliding channel section will provide a space for rotation of said rotational thumb nut on said screw threaded rod between said screw threaded rod retaining section and said hollow flanged tube.

7. The assembly of claim 1, wherein said rotational thumb nut has linear movement both in a clockwise and anticlockwise direction on said screw threaded rod between said hollow flanged tube and said screw threaded rod retaining section thereby providing adjustment of said gliding channel section on said screw threaded rod relative to said base and said respective ladder stile.

8. The assembly of claim 1, wherein said gliding channel section being free moving on said screw threaded rod between said rotational thumb nut and said first locking nut at said screw threaded rod fixing platform.

9. The assembly of claim 1, wherein said third aperture of said base comprises a latch keeper.

10. The assembly of claim 1, wherein said rocking section further comprises a latch in said third aperture, wherein said latch is configured to line with a latch keeper of said base.

11. The assembly of claim 9, wherein said rocking section further comprises a latch in said third aperture, wherein said latch is configured to line with the latch keeper of said base.

12. The assembly of claim 1, wherein said non-gliding channel section has a clear area on an outer surface between said screw threaded rod fixing platform and a third centrally located aperture, wherein the area will provide a surface for adoption of other connections.

13. The assembly of claim 3, wherein said non-gliding channel section has a clear area on an outer surface between said screw threaded rod fixing platform and said third centrally located aperture, wherein the area will provide a surface for adoption of other connections.

14. The assembly of claim 3, wherein the assembly is configured to be controlled by the use of one hand.

15. The assembly of claim 1, wherein said hollow flanged tube comprises a hollow member, wherein said hollow member has flared ends, wherein said hollow member will not cause damage to said screw threaded rod threading.

16. The assembly of claim 1, wherein the three of said five visible brake-pressed folded bends of said non-gliding channel section at the one end and five of said five visible brake-pressed folded bends of said gliding channel section being configured to mate and attach to a cylindrical object.

17. The assembly of claim 1, wherein said five visible brake-pressed folded bends of said non-gliding channel section, said five visible brake-pressed folded bends of said gliding channel section, said three visible brake pressed folded bends of said base and said three visible brake-pressed folded bends of said rocking section are press formed, punched or moulded.

18. The assembly of claim 1, wherein said screw threaded rod, and said rotational thumb nut comprise a quick release mechanism.

* * * * *